US009937745B1

(12) United States Patent
Van Bogaert

(10) Patent No.: US 9,937,745 B1
(45) Date of Patent: Apr. 10, 2018

(54) METHOD FOR MEMORIALIZING A SPORTS JERSEY

(71) Applicant: John Peter Van Bogaert, Tucson, AZ (US)

(72) Inventor: John Peter Van Bogaert, Tucson, AZ (US)

( * ) Notice: Subject to any disclaimer, the term of this patent is extended or adjusted under 35 U.S.C. 154(b) by 557 days.

(21) Appl. No.: 14/607,311

(22) Filed: Jan. 28, 2015

Related U.S. Application Data

(63) Continuation-in-part of application No. 13/456,070, filed on Apr. 25, 2012, now abandoned.

(60) Provisional application No. 61/484,584, filed on May 10, 2011.

(51) Int. Cl.
*B44C 3/02* (2006.01)
*B44C 5/00* (2006.01)
*B44C 5/04* (2006.01)

(52) U.S. Cl.
CPC ..... *B44C 5/0415* (2013.01); *B44C 3/02* (2013.01)

(58) Field of Classification Search
CPC ..... B44C 5/0415; B44C 3/02
See application file for complete search history.

(56) References Cited

U.S. PATENT DOCUMENTS 2,116,471 A 5/1938 Nelson
3,908,056 A 9/1975 Anderson
6,565,415 B1 * 5/2003 Christiansen ..... B24B 29/005 451/359

FOREIGN PATENT DOCUMENTS

JP 2007001159 A 1/2007

* cited by examiner

*Primary Examiner* — Jeffry H Aftergut

(57) ABSTRACT

A method for memorializing a sports jersey via creating a shimmering light-reflective pattern resembling a three-dimensional wave on a plurality of two-dimensional metallic surfaces features obtaining a plurality of planar metallic blanks. The method features obtaining an angle grinder having a circular grinding disc located thereon. The method features embedding a first series of arc-shaped striations sequentially located one above another along a first striation axis on each metallic blank via operation of the angle grinder. The method features embedding subsequent series' of arc-shaped striations sequentially located one above another along subsequent striation axes on each metallic blank via operation of the angle grinder. This step is repeated until the desired shimmering light-reflective pattern resembling a three-dimensional wave on a two-dimensional metallic surface is achieved. The method features assembling the metallic blanks, one atop of another creating layers.

5 Claims, 9 Drawing Sheets
(8 of 9 Drawing Sheet(s) Filed in Color)

METHOD FOR MEMORIALIZING A SPORTS JERSEY

CROSS REFERENCE

This application claims priority to U.S. patent application Ser. No. 13/456,070 filed Apr. 25, 2012, as a continuation-in-part and claims priority to U.S. Provisional Patent Application No. 61/484,584 filed May 10, 2011, the specification(s) of which is/are incorporated herein in their entirety by reference.

FIELD OF THE INVENTION

The present invention relates to metallic art and methods for creating light-reflective patterns on a metallic surface.

BACKGROUND OF THE INVENTION

Art has been used as a means to capture thoughts, feelings, and emotions since the dawn of mankind. Today, photographic images, videos, drawings, paintings, and the like are often used to capture these moments. Sometimes, objects and souvenirs such as sports jerseys are kept for similar reasons. The present invention features a method for memorializing a sports jersey via creating a shimmering light-reflective pattern resembling a three-dimensional wave on a plurality of two-dimensional metallic surfaces. A metallic surface can be more durable than woven cloth often used in making sports jerseys.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a method for memorializing a sports jersey via creating a shimmering light-reflective pattern resembling a three-dimensional wave on a plurality of two-dimensional metallic surfaces. In some embodiments, the method comprises obtaining a plurality of planar metallic blanks.

In some embodiments, the method comprises obtaining an angle grinder having a circular grinding disc rotatingly located thereon.

In some embodiments, the method comprises embedding a first series of arc-shaped striations sequentially located one above another along a first striation axis on each metallic blank via operation of the angle grinder. In some embodiments, each arc-shaped striation in the series is located at a same orientation with respect to an edge of each metallic blank; and embedding subsequent series' of arc-shaped striations sequentially located one above another along subsequent striation axes on each metallic blank via operation of the angle grinder. In some embodiments, each arc-shaped striation in the series is located at a same orientation with respect to an edge of each metallic blank. In some embodiments, the step is repeated until the desired shimmering light-reflective pattern resembling a three-dimensional wave on a two-dimensional metallic surface is achieved.

In some embodiments, the method comprises assembling the metallic blanks, one atop of another creating layers. In some embodiments, a first metallic blank is a base layer. In some embodiments, a second metallic blank is a jersey body layer. In some embodiments, the jersey body layer is located on a top surface of the base layer. In some embodiments, each layer of the metallic blanks combines to create a shimmering light-reflective pattern resembling a three-dimensional wave on a two-dimensional metallic surface for memorializing a sports jersey.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DESCRIPTION OF PREFERRED EMBODIMENTS

Following is a list of elements corresponding to a particular element referred to herein:

100 Blank
102 Blank edge
105 Aperture
110 Striation

Figure 1:
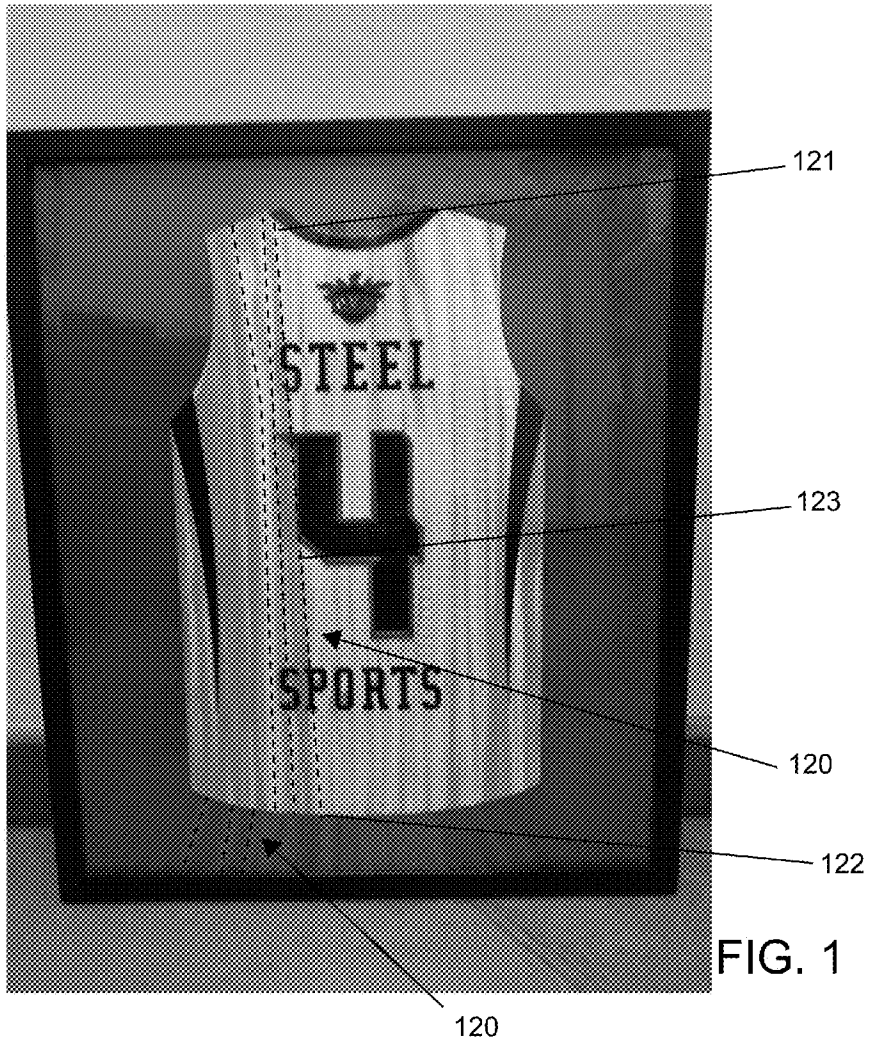
FIG. 1 shows a front view illustrating the method of the present invention with each layer of the metallic blanks combining to create a shimmering light-reflective pattern resembling a three-dimensional wave on a two-dimensional metallic surface for memorializing a sports jersey.
Figure 2:
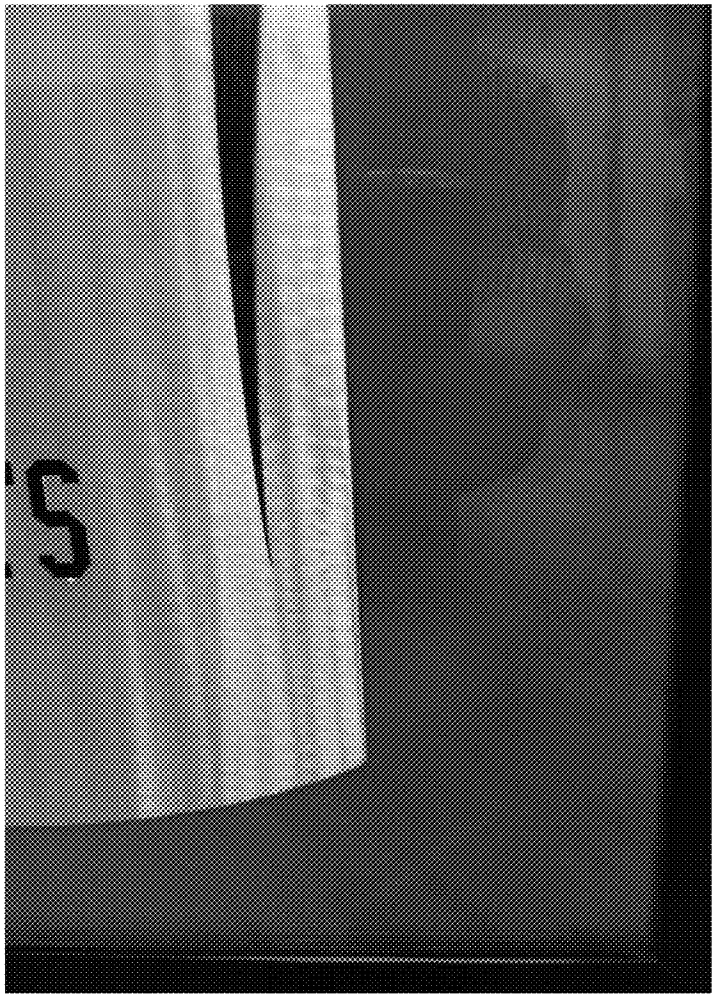
FIG. 2 shows a close-up view illustrating the method of the present invention highlighting a series of striations and striation axes and an overlay metallic blank.
Figure 3:
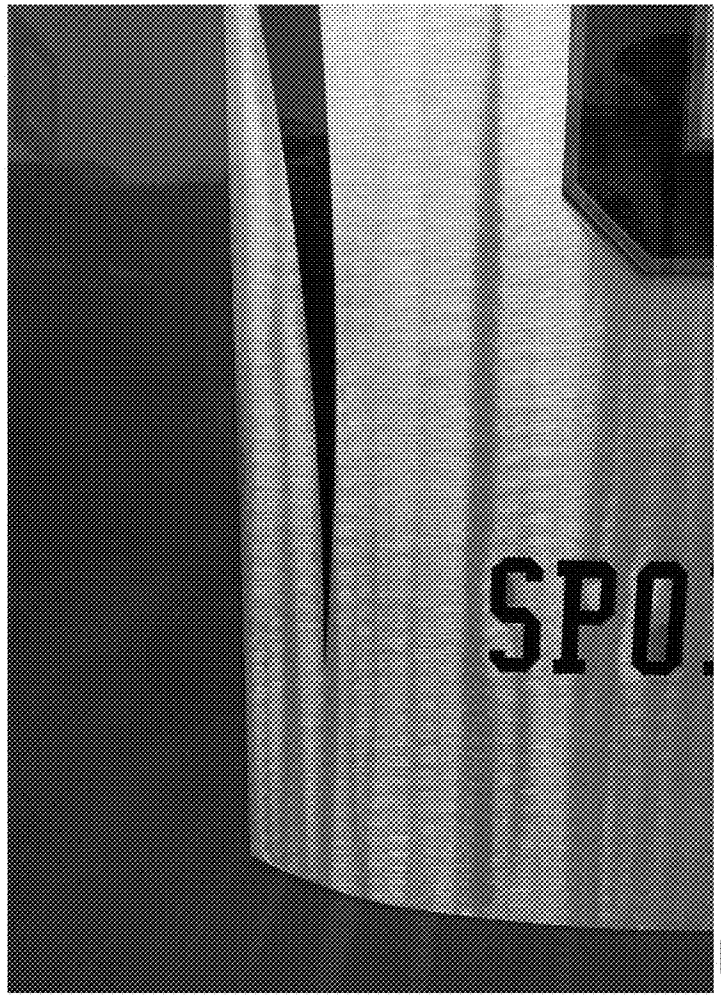
FIG. 3 shows a close-up view illustrating the method of the present invention highlighting a series of striations and striation axes and an overlay metallic blank.
Figure 4:
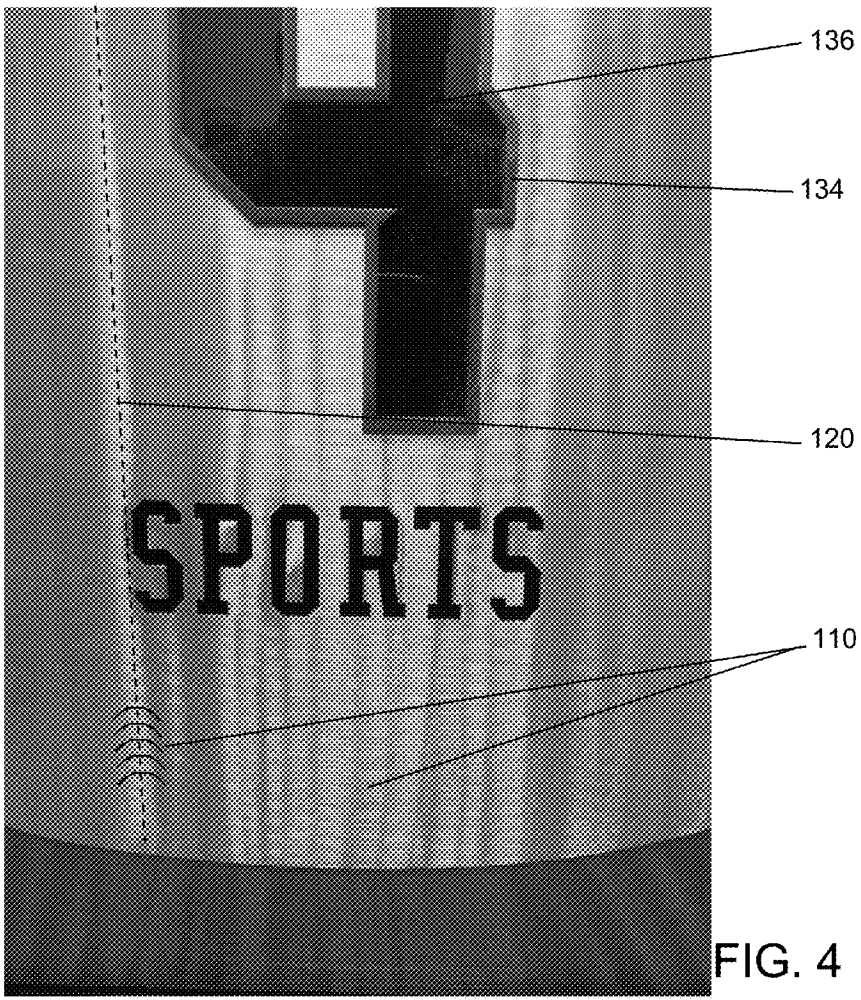
FIG. 4 shows a close-up view illustrating the method of the present invention highlighting a series of striations along a striation axis.
Figure 5:
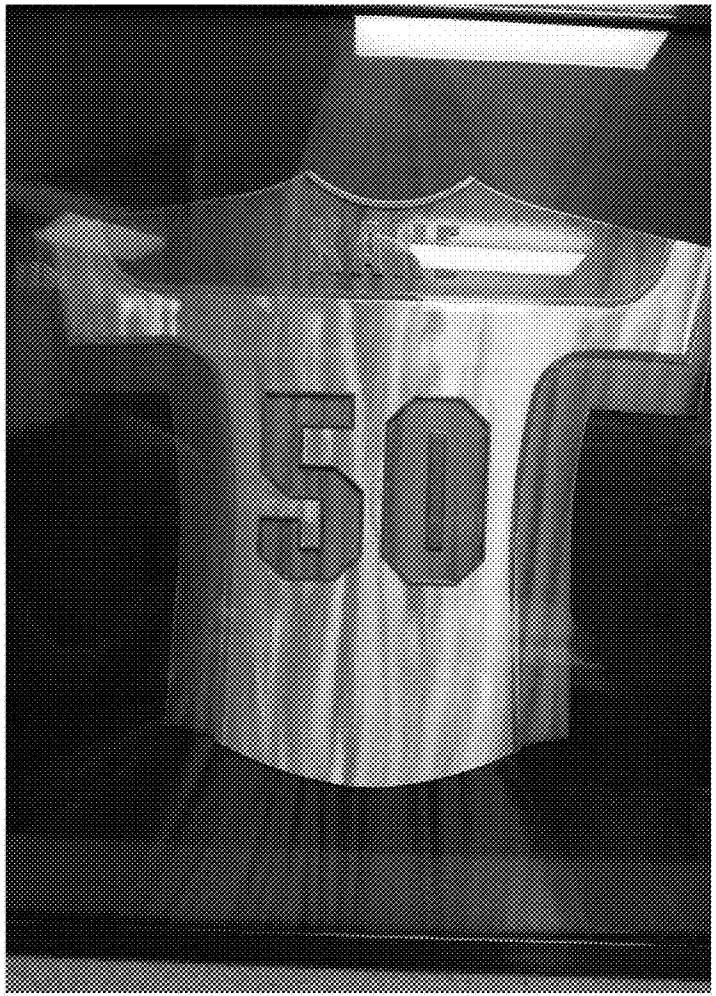
FIG. 5 shows a front view illustrating the method of the present invention with each layer of the metallic blanks combining to create a shimmering light-reflective pattern resembling a three-dimensional wave on a two-dimensional metallic surface for memorializing a sports jersey.
Figure 6:
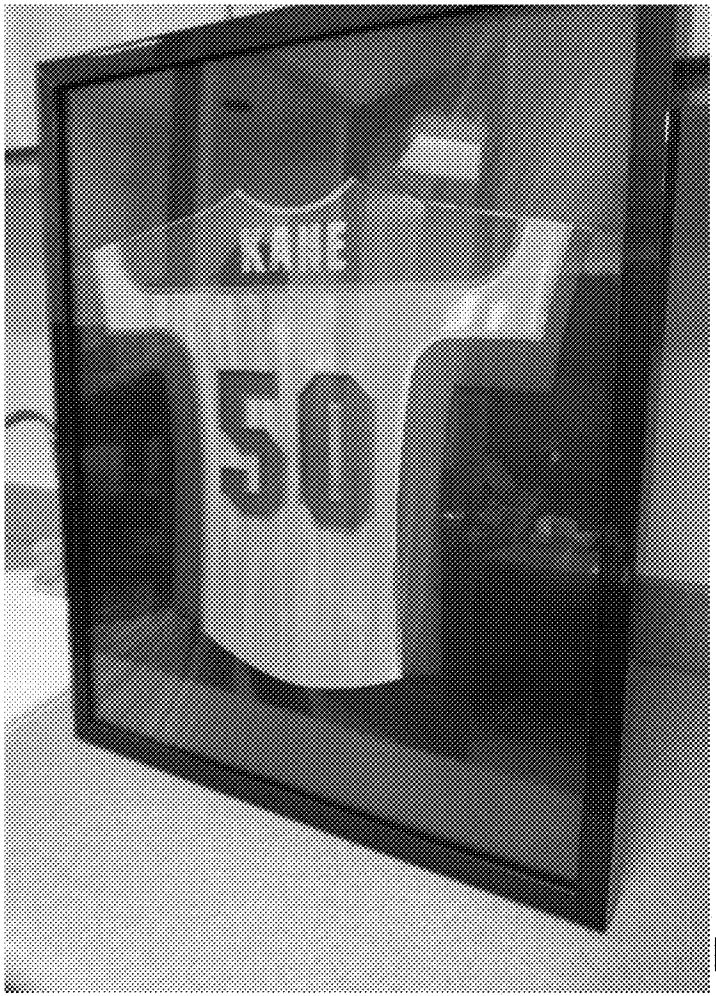
FIG. 6 shows a side angled view illustrating the method of the present invention with each layer of the metallic blanks combining to create a shimmering light-reflective pattern resembling a three-dimensional wave on a two-dimensional metallic surface for memorializing a sports jersey.
Figure 7:
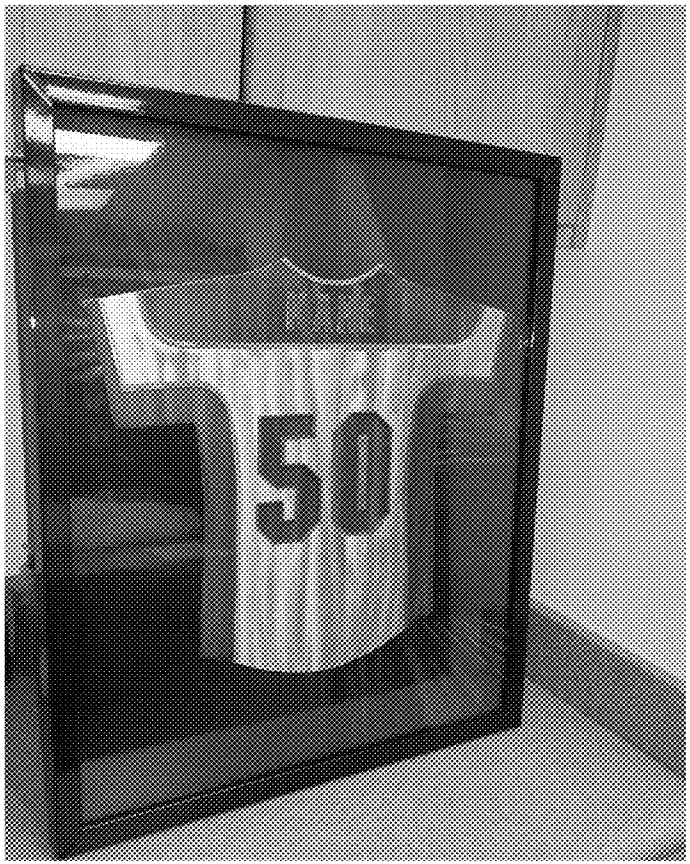
FIG. 7 shows a side angled view illustrating the method of the present invention with each layer of the metallic blanks combining to create a shimmering light-reflective pattern resembling a three-dimensional wave on a two-dimensional metallic surface for memorializing a sports jersey.
Figure 8:
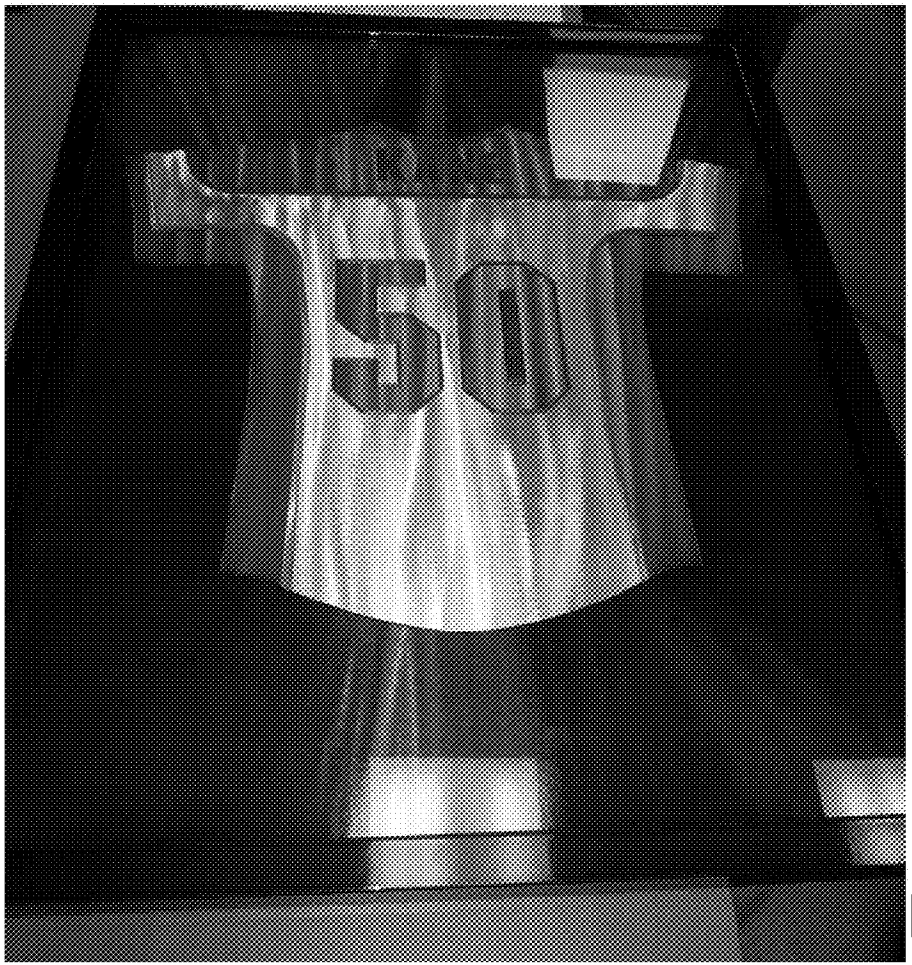
FIG. 8 shows a bottom angled view illustrating the method of the present invention with each layer of the metallic blanks combining to create a shimmering light-reflective pattern resembling a three-dimensional wave on a two-dimensional metallic surface for memorializing a sports jersey.
Figure 9:
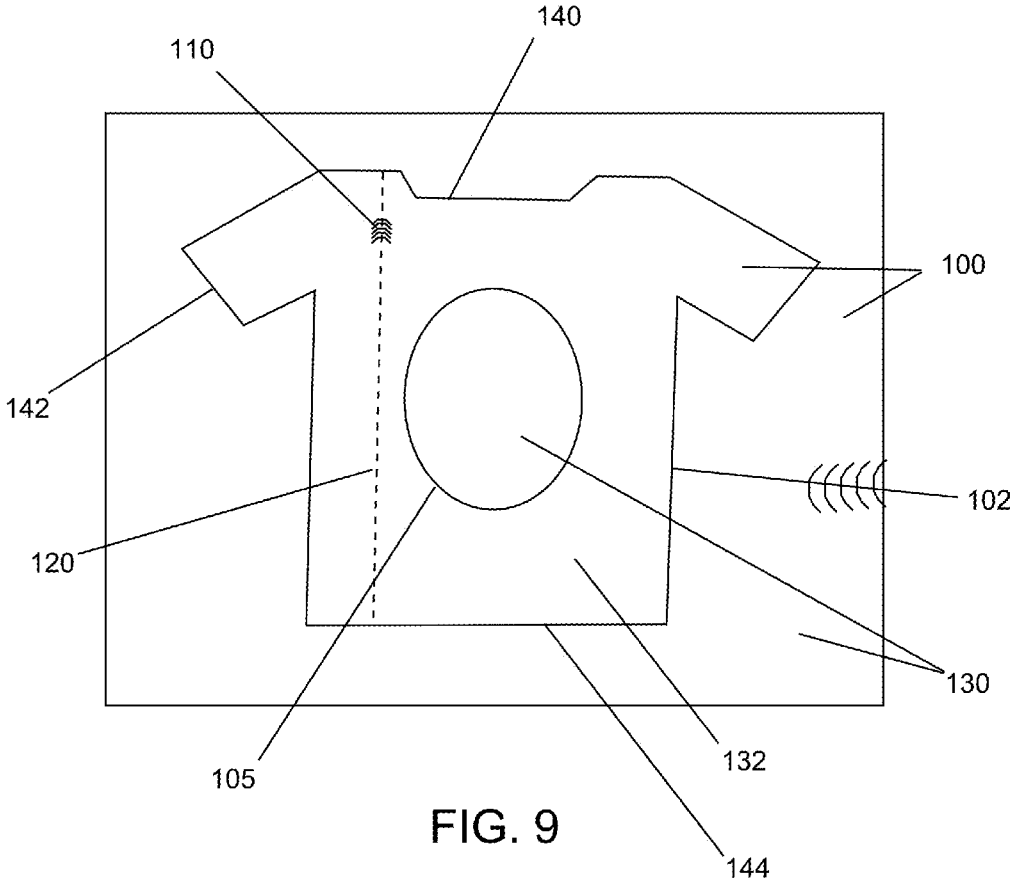
FIG. 9 shows a front schematic view illustrating the method of the present invention highlighting a series of striations along a striation axis.

120 Striation axis
121 Axis first end
122 Axis second end
123 Axis midpoint
130 Base layer
132 Jersey body layer
134 Overlay metallic blank
136 Underlay metallic blank
140 Neck opening edge
142 Sleeve opening edge
144 Torso opening edge Referring now to FIG. 1-9, the present invention features a method for creating a shimmering light-reflective pattern resembling a three-dimensional wave on a two-dimensional metallic surface. In some embodiments, the method comprises obtaining a planar metallic blank (100).

In some embodiments, the method comprises obtaining an angle grinder having a circular grinding disc rotatingly located thereon. In some embodiments, the grinding disc is a 4 inch grinding disc. In some embodiments, the grinding disc is a 7 inch grinding disc. In some embodiments, the grinding disc is a 4.5 inch grinding disc. In some embodiments, the grinding disc is between 1 inches and 2 inches in diameter. In some embodiments, the grinding disc is between 2 inches and 3 inches in diameter. In some embodiments, the grinding disc is between 4 inches and 5 inches in diameter. In some embodiments, the grinding disc is between 5 inches and 6 inches in diameter. In some embodiments, the grinding disc is between 6 inches and 8 inches in diameter. In some embodiments, the grinding disc is larger than 8 inches in diameter.

In some embodiments, the method comprises embedding a first series of arc-shaped striations (110) sequentially located one above another along a first striation axis (120) on the metallic blank (100) via operation of the angle grinder. In some embodiments, each arc-shaped striation (110) in the series is located at a same orientation with respect to an edge (102) of the metallic blank (100). In some embodiments, each arc-shaped striation (110) is ½ inch wide. In some embodiments, each arc-shaped striation (110) is 1 inch wide. In some embodiments, each arc-shaped striation (110) is 2 inches wide. In some embodiments, each arc-shaped striation (110) is 3 inches wide. In some embodiments, each arc-shaped striation (110) is 4 inches wide. In some embodiments, each arc-shaped striation (110) is 5 inches wide.

In some embodiments, a striation (110) is created when a piece of abrasive material on the grinding disc is rotated via the angle grinder and applied against the metallic blank (100). The abrasive material cuts an arc-shaped channel into a surface of the metallic blank (100). When light shines on the metallic blank (100) the shape, location and number of arc-shaped channels, or striations (110) creates an optical effect. When striations (110) are grouped along a striation axis (120), an optical effect is created. When a series of striation axes (120) is created an optical effect is created that resembles draped, shimmery cloth such as satin, nylon, or silk.

In some embodiments, the method comprises embedding subsequent series' of arc-shaped striations (110) sequentially located one above another along subsequent striation axes (120) on the metallic blank (100) via operation of the angle grinder. In some embodiments, each arc-shaped striation (110) in a series is located at a same orientation with respect to an edge (102) of the metallic blank (100). In some embodiments, the step is repeated until the desired shimmering light-reflective pattern resembling a three-dimensional wave on a two-dimensional metallic surface is achieved. In some embodiments, the spacing between each arc-shaped striation (110) is determined by the speed at which the angle grinder is moved along the striation axis (120).

In some embodiments, the striation axes (120) each comprise an axis first end (121), an axis midpoint (123), and an axis second end (122).

In some embodiments, shadows between striation axes (120) are created by overlaying two striation axes (120) a distance apart from one another.

In some embodiments, the striation axes (120) are located parallel with respect to one another.

In some embodiments, the striation axes (120) are located in a sunburst pattern. In some embodiments, the axis first end (121) of each striation axis (120) intersects.

In some embodiments, the striation axes (120) are located in a sunburst pattern. In some embodiments, the axis midpoint (123) of each striation axis (120) intersects.

In some embodiments, a first group of striation axes (120) are located parallel with respect to one another and a second group of striation axes (120) are located parallel with respect to one another. In some embodiments, the first group of striation axes (120) is located at an angle with respect to the second group of striation axes (120). In some embodiments, the angle is between 0 and 30 degrees. In some embodiments, the angle is between 30 and 60 degrees. In some embodiments, the angle is between 60 and 90 degrees.

In some embodiments, the grinding disc is a resin fiber grinding disc. In some embodiments, the grinding disc comprises aluminum oxide abrasive particles. In some embodiments, the grinding disc comprises zirconia alumina abrasive particles. In some embodiments, the grinding disc comprises ceramic resin abrasive particles. In some embodiments, the grinding disc comprises ceramic abrasive particles. In some embodiments, the grinding disc is a 16 grit disc. In some embodiments, the grinding disc is a 24 grit disc. In some embodiments, the grinding disc is a 36 grit disc. In some embodiments, the grinding disc is a 40 grit disc. In some embodiments, the grinding disc is a 60 grit disc. In some embodiments, the grinding disc is a 80 grit disc. In some embodiments, the grinding disc is a 120 grit or higher disc.

In some embodiments, the striation axes (120) are linear. In some embodiments, the striation axes (120) are curved or irregularly curved.

In some embodiments, the metallic blank (100) is aluminum.

In some embodiments, the metallic blank (100) is steel.

In some embodiments, the metallic blank (100) is stainless steel.

In some embodiments, the method comprises applying a transparent coating to the metallic blank (100) once striations (110) are embedded. In some embodiments, the coating is powder coating. In some embodiments, the coating is paint. In some embodiments, the coating is plastic. In some embodiments, the coating is a polymer.

In some embodiments, the method comprises applying a translucent coating to the metallic blank (100) once striations (110) are embedded. In some embodiments, a plurality of metallic blanks (100) are coated with a translucent or transparent coating in a plurality of colors to create a contrast.

In some embodiments, the metallic blank (100) comprises one or more apertures (105) located therein. In some embodiments, the apertures are round. In some embodiments, the apertures are irregularly shaped.

In some embodiments, the method comprises obtaining one or more additional metallic blanks (100). In some embodiments, the metallic blanks are less than 1/16 inch in thickness. In some embodiments, the metallic blanks are between 1/16 inch and 1/8 inch in thickness. In some embodiments, the metallic blanks are between 1/8 inch and 1/4 inch in thickness. In some embodiments, the metallic blanks are greater than 1/4 inch in thickness.

In some embodiments, the method comprises embedding a first series of arc-shaped striations (110) sequentially located one above another along a first striation axis (120) on each metallic blank (100) via operation of the angle grinder. In some embodiments, each arc-shaped striation (110) in a series is located at a same orientation with respect to an edge (102) of each metallic blank (100). In some embodiments, the method comprises embedding subsequent series' of arc-shaped striations (110) sequentially located one above another along subsequent striation axes (120) on each metallic blank (100) via operation of the angle grinder. In some embodiments, each arc-shaped striation (110) in a series is located at a same orientation with respect to an edge (102) of each metallic blank (100). In some embodiments, the step is repeated until the desired shimmering light-reflective pattern resembling a three-dimensional wave on a two-dimensional metallic surface is achieved.

In some embodiments, the method comprises attachably assembling the metallic blanks (100), one atop of another creating layers. In some embodiments, the metallic blanks (100) are epoxied to each other. In some embodiments, the metallic blanks (100) are fastened to each other using fastening hardware.

In some embodiments, each layer of the metallic blanks (100) comprises a unique combination of arc-shaped striations (110) sequentially located one above another. In some embodiments, each layer of the metallic blanks (100) combines to create the unique shimmering light-reflective pattern resembling a three-dimensional wave on a two-dimensional metallic surface.

A method for memorializing a sports jersey via creating a shimmering light-reflective pattern resembling a three-dimensional wave on a plurality of two-dimensional metallic surfaces. In some embodiments, the method comprises obtaining a plurality of planar metallic blanks (100).

In some embodiments, the method comprises obtaining an angle grinder having a circular grinding disc rotatingly located thereon.

In some embodiments, the method comprises embedding a first series of arc-shaped striations (110) sequentially located one above another along a first striation axis (120) on each metallic blank (100) via operation of the angle grinder. In some embodiments, each arc-shaped striation (110) in a series is located ata same orientation with respect to an edge (102) of each metallic blank (100). In some embodiments, the method comprises embedding subsequent series' of arc-shaped striations (110) sequentially located one above another along subsequent striation axes (120) on each metallic blank (100) via operation of the angle grinder. In some embodiments, each arc-shaped striation (110) in a series is located at a same orientation with respect to an edge (102) of each metallic blank (100). In some embodiments, the step is repeated until the desired shimmering light-reflective pattern resembling a three-dimensional wave on a two-dimensional metallic surface is achieved.

In some embodiments, the striation axes (120) each comprise an axis first end (121), an axis midpoint (123), and an axis second end (122).

In some embodiments, the method comprises attachably assembling the metallic blanks (100), one atop of another creating layers. In some embodiments, a first metallic blank (100) is a base layer (130). In some embodiments, a second metallic blank (100) is a jersey body layer (132). In some embodiments, the jersey body layer (132) is located on a top surface of the base layer (130).

In some embodiments, each layer of the metallic blanks (100) comprises a unique combination of arc-shaped striations (110) sequentially located one above another. In some embodiments, each layer of the metallic blanks (100) combines to create a unique shimmering light-reflective pattern resembling a three-dimensional wave on a two-dimensional metallic surface.

In some embodiments, an overlay metallic blank (134) is located on a top surface of the jersey body layer (132). In some embodiments, one or more overlay metallic blanks (134) are used on the jersey body layer (132) to create a contrasting effect for light distribution or color.

In some embodiments, an underlay metallic blank (136) is located on a top surface of the base layer (130). In some embodiments, a top surface of the underlay metallic blank (136) is located against a bottom surface of the jersey body layer (132). In some embodiments, the underlay metallic blank (136) is located between the base layer (130) and the jersey body layer (132). In some embodiments, one or more underlay metallic blanks (136) are used on the jersey body layer (132) to create a contrasting effect for light distribution or color.

In some embodiments, the jersey body layer (132) comprises a neck opening edge (140), a sleeve opening edge (142), and a torso opening edge (144) located opposite the neck opening edge (140). In some embodiments, a plurality of striation axes (120) located on the base layer (130) is located at an angle of ninety degrees with respect to the neck opening edge (140) at the neck opening edge (140), thus creating a visual impression resembling a neck. In some embodiments, a plurality of striation axes (120) located on the base layer (130) is located at an angle of ninety degrees with respect to the sleeve opening edge (142) at the sleeve opening edge (142), thus creating a visual impression resembling an arm. In some embodiments, a plurality of striation axes (120) located on the base layer (130) is located at an angle of ninety degrees with respect to the torso opening edge (144) at the torso opening edge (144), thus creating a visual impression resembling a torso.

As used herein, the term "about" refers to plus or minus 10% of the referenced number.

The disclosures of the following U.S. Patents are incorporated in their entirety by reference herein: U.S. Pat. No. 2,116,471, Nelson; Patent Pub. No. JP2007/001159, Tada et al.; and U.S. Pat. No. 3,908,056, Anderson.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A method for creating a shimmering light-reflective pattern resembling a three-dimensional wave on a two-dimensional metallic surface, Wherein the method comprises:

(a) obtaining a planar metallic blank (100);

(b) obtaining an angle grinder having a circular grinding disc rotatingly disposed thereon;

(c) embedding a first series of arc-shaped striations (110) sequentially disposed one above another along a first striation axis (120) on the metallic blank (100) via application and operation of the angle grinder, wherein each arc-shaped striation (110) in the series is disposed at a same orientation with respect to an edge (102) of the metallic blank (100);

(d) embedding subsequent series of arc-shaped striations (110) sequentially disposed one above another along subsequent striation axes (120) on the metallic blank (100) via application and operation of the angle grinder, wherein each arc-shaped striation (110) in a series is disposed at a same orientation with respect to an edge (102) of the metallic blank (100), wherein the step is repeated until the desired shimmering light-reflective pattern resembling a three-dimensional wave on a two-dimensional metallic surface is achieved, (e) obtaining one or more additional metallic blanks (100);

(f) embedding a first series of arc-shaped striations (110) sequentially disposed one above another along a first striation axis (120) on each metallic blank (100) via application and operation of the angle grinder, wherein each arc-shaped striation (110) in a series is disposed at a same orientation with respect to an edge (102) of each metallic blank (100); and embedding subsequent series of arc-shaped striations (110) sequentially disposed one above another along subsequent striation axes (120) on each metallic blank (100) via application and operation of the angle grinder, wherein each arc-shaped striation (110) in a series is disposed at a same orientation with respect to an edge (102) of each metallic blank (100), wherein the step is repeated until the desired shimmering light-reflective pattern resembling a three-dimensional wave on a two-dimensional metallic surface is achieved; and (g) attachably assembling the metallic blanks (100), one atop of another creating layers;

wherein the striation axes (120) each comprises an axis first end (121), an axis midpoint and an axis second end (122) wherein each layer of the metallic blanks (100) comprises a unique combination of arc-shaped striations (110) sequentially disposed one above another, wherein each layer of the metallic blanks (100) combines to create the unique shimmering light-reflective pattern resembling a three-dimensional wave on a two-dimensional metallic surface.

2. A method for memorializing a sports jersey via creating a shimmering light-reflective pattern resembling a three-dimensional wave on a plurality of two-dimensional metallic surfaces, wherein the method comprises:

(a) obtaining a plurality of planar metallic blanks (100);

(b) obtaining an angle grinder having a circular grinding disc rotatingly disposed thereon;

(c) embedding a first series of arc-shaped striations (110) sequentially disposed one above another along a first striation axis (120) on each metallic blank (100) via application and operation of the angle grinder, wherein each arc-shaped striation (110) in a series is disposed at a same orientation with respect to an edge (102) of each metallic blank (100); and embedding subsequent series' of arc-shaped striations (110) sequentially disposed one above another along subsequent striation axes (120) on each metallic blank (100) via application and operation of the angle grinder, wherein each arc-shaped striation (110) in a series is disposed at a same orientation with respect to an edge (102) of each metallic blank (100), wherein the step is repeated until the desired shimmering light-reflective pattern resembling a three-dimensional wave on a two-dimensional metallic surface is achieved;

wherein the striation axes (120) each comprise an axis first end (121), an axis midpoint and an axis second end (122); and (c) attachably assembling the metallic blanks (100), one atop of another creating layers, wherein a first metallic blank (100) is a base layer (130), wherein a second metallic blank (100) is a jersey body layer (132), wherein the jersey body layer (132) is disposed on a top surface of the base layer (130);

wherein each layer of the metallic blanks (100) comprises a unique combination of arc-shaped striations (110) sequentially disposed one above another, wherein each layer of the metallic blanks (100) combines to create a unique shimmering light-reflective pattern resembling a three-dimensional wave on a two-dimensional metallic surface.

3. The method of claim 2, wherein an overlay metallic blank (134) is disposed on a top surface of the jersey body layer (132).

4. The method of claim 2, wherein an underlay metallic blank (136) is disposed on a top surface of the base layer (130), wherein a top surface of the underlay metallic blank (136) is disposed against a bottom surface of the jersey body layer (132), wherein the underlay metallic blank (136) is disposed between the base layer (130) and the jersey body layer (132).

5. The method of claim 2, wherein the jersey body layer (132) comprises a neck opening edge (140), a sleeve opening edge (142), and a torso opening edge (144) disposed opposite the neck opening edge (140), wherein a plurality of striation axes (120) disposed on the base layer (130) is disposed at an angle of ninety degrees with respect to the neck opening edge (140) at the neck opening edge (140), wherein a plurality of striation axes (120) disposed on the base layer (130) is disposed at an angle of ninety degrees with respect to the sleeve opening edge (142) at the sleeve opening edge (142), wherein a plurality of striation axes (120) disposed on the base layer (130) is disposed at an angle of ninety degrees with respect to the torso opening edge (144) at the torso opening edge (144).

* * * * *